US007191848B2

(12) United States Patent
Ha

(10) Patent No.: US 7,191,848 B2
(45) Date of Patent: Mar. 20, 2007

(54) ROLLING HAMMER DRILL

(76) Inventor: Bob H. Ha, 8111 - 85 Avenue, Edmonton, Alberta (CA) T6C 1G4

( * ) Notice: Subject to any disclaimer, the term of this patent is extended or adjusted under 35 U.S.C. 154(b) by 128 days.

(21) Appl. No.: 10/886,604

(22) Filed: Jul. 9, 2004

(65) Prior Publication Data

US 2006/0016612 A1 Jan. 26, 2006

(51) Int. Cl.
*B25D 17/00* (2006.01)

(52) U.S. Cl. ..... 173/122; 173/93; 173/93.5; 173/109; 173/114

(58) Field of Classification Search ..... 173/93, 173/93.5, 104, 109, 114, 122, 124, 205
See application file for complete search history.

(56) References Cited

U.S. PATENT DOCUMENTS 2,974,533 A * 3/1961 Demo ..... 74/22 R
3,133,602 A * 5/1964 Fulop ..... 173/109
3,149,681 A 9/1964 Drew
3,163,237 A * 12/1964 Fulon ..... 173/109
3,363,700 A * 1/1968 Bogusch, Jr. ..... 173/109
5,711,380 A * 1/1998 Chen ..... 173/48
6,000,512 A * 12/1999 Cronin et al. ..... 192/38
6,059,049 A * 5/2000 Lin ..... 173/93.5
6,196,332 B1 * 3/2001 Albert et al. ..... 173/176
6,230,819 B1 * 5/2001 Chen ..... 173/48
6,684,964 B2 2/2004 Ha

* cited by examiner

*Primary Examiner*—John Sipos
*Assistant Examiner*—Nathaniel Chukwurah

(57) ABSTRACT

A hammer drill with rolling contact at the contact surfaces for transmission of axial force between a drive shaft and wave race. By using roller bearings, line contact is obtained. The area of contact is thus close to zero as opposed to a relatively large area in engagement systems using toothed surfaces. Use of point or line contact reduces heat generation and reduces energy loss due to friction.

7 Claims, 4 Drawing Sheets

ROLLING HAMMER DRILL

BACKGROUND OF THE INVENTION

Hammer drills are known in which rotation of toothed surfaces against each other causing a hammering action. Also, in U.S. Pat. Nos. 3,149,681 and 3,133,602, rotary impact hammers with a ball on tooth engagement provide for a hammering action only in one direction of rotation. A ball on tooth engagement also tends to wear a groove in the tooth, which tends to create a wide contact area between ball and tooth. Together with the immobility of the tooth surface, the wide contact area increases friction losses and heating of the tool. A further hammer drill is disclosed in U.S. Pat. No. 6,684,964, in which the hammer action is provided by impact of facing sets of bearings. This design suffers from increased wear and friction losses from the impact on the bearings on each other.

SUMMARY OF THE INVENTION

The present invention describes a hammer drill using a rolling hammer action. The rolling hammer is based on a journal bearing support principal. The reciprocating action required for hammer drilling produces high impact loading and vibration. Wear is accelerated whenever true rolling contact or a consistent hydrodynamic lubrication film is not maintained. This is particularly true for the sliding ramp or ratchet design when contact is interrupted as the ramps disengage at the end of each stroke. A similar situation occurs in the piston design when the piston reverses its direction at both ends of its stroke.

The true rolling contact provided by the proposed rolling hammer mechanism has the advantages of providing full fluid lubrication for both the journal and true rolling support functions that reduce friction and wear, longer service life than comparable products, and distribution and dissipation of heat (which influences the operation temperature), permissible speed and the load carrying capacity of the journal and true rolling functions.

The rolling hammer drill is a simple, unique and easily built mechanism. It produces a strong single impact energy with a precise impact frequency that results in faster removal rates and increased drill bit life regardless of size. With only minor design changes, rolling hammer mechanism models can be built with stroke magnitudes and impact frequencies for a wide range of applications. The unique, smooth rolling curves create a better, lower vibration and well-shaped impact pulses for drilling holes that is ergonomically more comfortable. Reduced uncontrolled fracturing of concrete during drilling is another benefit. The rolling hammer drill mechanism achieves efficiency and long life, with zero maintenance requirements and low production cost ideal for industrial, commercial and residential applications.

Therefore there is provided in accordance with an aspect of the invention, a hammer drill with rolling contact at the contact surfaces for transmission of axial force between a drive shaft and wave race. By using roller bearings, line contact is obtained. The area of contact is thus close to zero as opposed to a relatively large area in engagement systems using toothed surfaces. Use of point or line contact reduces heat generation and reduces energy loss due to friction.

In some prior art products, a release clutch is used to release torque when pressure is critically increased and to prevent engagement parts from shear. In the case of a hammer drill with rolling contact, relatively low torque generators may be used where the torque does not exceed shearing stresses. The hammer drill of the present invention does not require the release clutch because it provides its function by rolling friction. When torque increases, the roller bearings, mounted in a stationary roller hub as part of the drive assembly, push the wave shaft in the hammer assembly, thus separating the hammer assembly from the drive assembly and releasing the torque. This repetitive action also generates a hammering effect. The contact points between the rotating bearing element and the wave shaft are between 0 and 90 degrees to the tool axis. This offset makes the shearing component of the reaction force to rotate the roller bearings inside their cavities in the roller hub, and its axial component makes the wave shaft climb over the rotating bearing elements. The rotating bearing elements are prevented from axial motion in relation to the roller hub, but are allowed to rotate freely within the roller hub's cavities.

These and other aspects of the invention are described in the detailed description of the invention and claimed in the claims that follow.

BRIEF DESCRIPTION OF THE DRAWINGS

Preferred embodiments of the invention are described, with reference to the drawings, by way of illustration only and not with the intention of limiting the scope of the invention, in which like numerals denote like elements and in which.

DETAILED DESCRIPTION OF THE DRAWINGS

In this patent document, the word "comprising" is used in its non-limiting sense to mean that items following the word in the sentence are included, and that items not specifically mentioned are not excluded. The use of the indefinite article "a" in the claims before an element means that one of the elements is specified, but does not specifically exclude others of the elements being present, unless the context clearly requires that there be one and only one of the elements.

Figure 1:
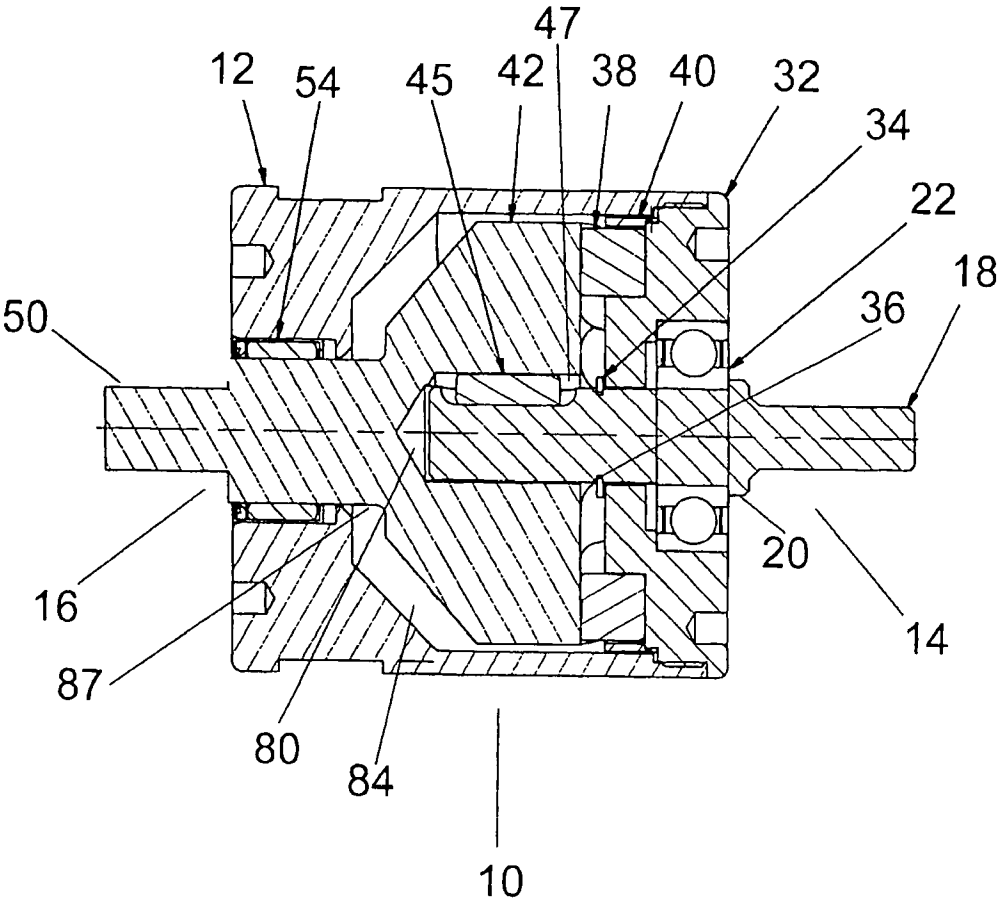
FIG. 1 is a section through of the rolling hammer drill according to the invention.

Referring to FIG. 1, there is shown a roller hammer drill adaptor, which includes two subassemblies mounted within a housing 12. A driver assembly 14 is directly connected to the chuck of a drill or power tool (not shown) and transfers torque from drill to a hammer assembly 16. The hammer assembly 16 converts received torque into torque and axial stroke motion. The driver assembly 14 may be formed as an integral part of a power tool.

The driver assembly 14 includes a drive shaft 18 with one end having a hexagonal shape in cross-section for connection into a chuck (not shown) of a conventional power tool. At the other end of the drive shaft 18 there is a pocket with three equally spaced roller slide cavities 43 that accept three torque transmitting rollers 45. Torque transmitting rollers 45 engage with roller slide grooves 43, not shown in FIG. 1, but shown in FIGS. 3*a* and 3*c,* rotationally fixing wave race 42 to drive shaft 18. The middle section of the drive shaft 18 is round in section and fits within a bearing housing 22 that supports the drive shaft 18 within the housing 12 for rotation relative to the housing 12. Bearing housing 22 is held in place on drive shaft 18 by shoulder 20, and may be for example use ball bearings.

Housing 12 is cylindrically shaped and has a round threaded opening for roller hub assembly 32 to be threaded into. A snap ring 34 engages a groove 36 on the drive shaft 18 to secure the roller hub assembly 32 in place and fixed axially in relation to the drive shaft 18, while the roller hub assembly 32 is fixed rotationally in relation to the housing 12.

Figure 2:
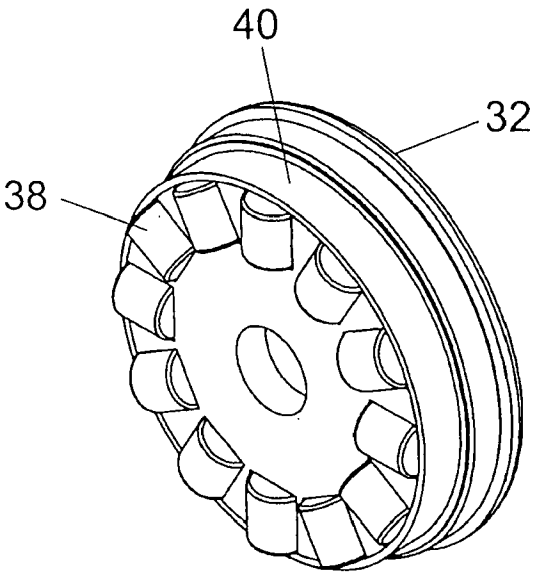
FIG. 2 is a three quarter detailed view of the roller hub assembly.

The roller hub assembly 32 fits into the opening of the bearing housing and has twelve circularly distributed cavities for position twelve roller bearings 38 as shown in FIG. 2. Roller hub assembly 32 also has an opening for fitting bearing housing 22.

Figure 3A:
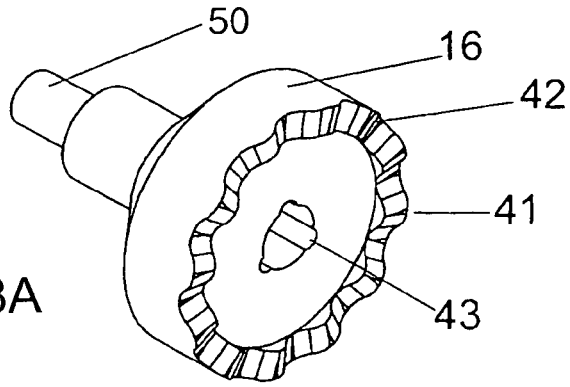
FIG. 3 is a three quarter detailed view of the wave race.
Figure 3B:
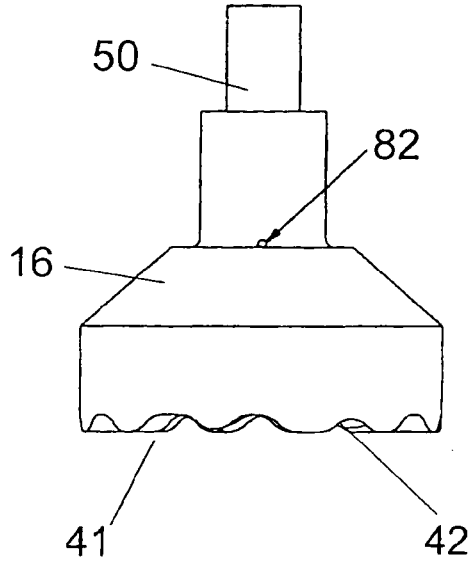
Figure 3C:
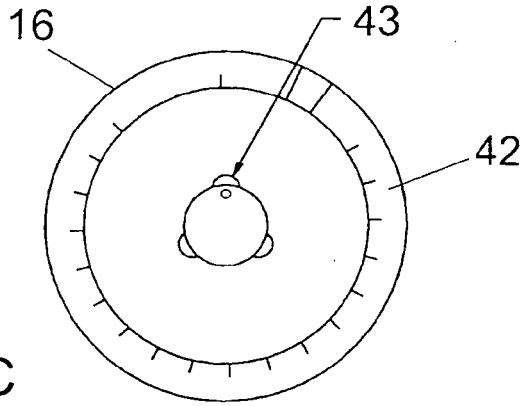

As shown in FIGS. 3*a* and 3*b,* the hammer assembly 16 has a face shaped to form a wave race 42. The matching cavities 43 of the hammer assembly 16 and rollers 45 of the drive shaft 18 permit the hammer assembly 16 and drive shaft 18 to rotate together while allowing relative axial movement between them. The working end 50 of hammer assembly 16 is threaded with 1/2-20 UN thread.

As shown in FIG. 2, roller hub assembly 32 has twelve circularly distributed cavities for position twelve rollers 38. Housing 12 is supported on hammer assembly 16 with needle bearings 54 that permit relative rotational movement of housing 12 in relation to hammer assembly 16. The rollers 38 are held by retaining ring 40 in the roller hub assembly 32.

Drive shaft 18 receives torque from a source (portable drill or electric motor) and transfers torque to hammer assembly 16 through the rollers 45. Roller hub assembly 32 stays steady in relation to the housing 12 due to the threaded connection of the roller hub assembly 32 to housing 12. Rollers 38 are free to rotate in the cavities in the roller hub assembly 32. Roller hub assembly 32 is held against axial movement on the drive shaft 18 by snap ring 34.

When the shaft 18 is rotated, hammer assembly 16 rotates with it. The housing 12 is held steady manually, which by virtue of the threaded connection of bearing housing 32 in the housing 12, holds the bearing housing 32 against rotation. The rollers 38 then rotate in relation to the wave race 42. With axial compression on the drive shaft 18 and hammer assembly 16, the waves on wave race 42 are initially located in gaps between rollers 38. As the wave race 42 rotates, the rollers 38 ride up and down on the waves of the wave race 42, causing axial movement of the hammer assembly 16 in relation to the drive shaft 18. The axial displacement is a function of the roller size and wave race wave amplitude.

Lubrication between wave race 42 and drive shaft 18 is provided through cavity 80 in the interior of the hammer assembly 16 which may be supplied with lubricant through hole 82. Hole 82, shown in FIG. 3*b,* is drilled in wave race 42 perpendicularly to the centre axis of hammer assembly 16. Hole 82 leads out to oil reservoir 84. Reciprocating action of the hammer assembly 16 in relation to the shaft 18 causes a vacuum effect that sucks lubricant from reservoir 84 through opening 82 into cavity 80 and thence along shaft 18 to the wave race 42 and bearings 38.

Referring to FIG. 3*a,* a three quarter view of the hammer assembly 16 is shown, showing fluted raceway 41 forming the face of the wave race 42. Fluted raceway 41 is also seen in FIG. 3*b.* Fluted raceway 41 may comprise twelve equal sinusoidal wave cycles in 360° with an amplitude of 0.120".

Figures 4A, 4B:
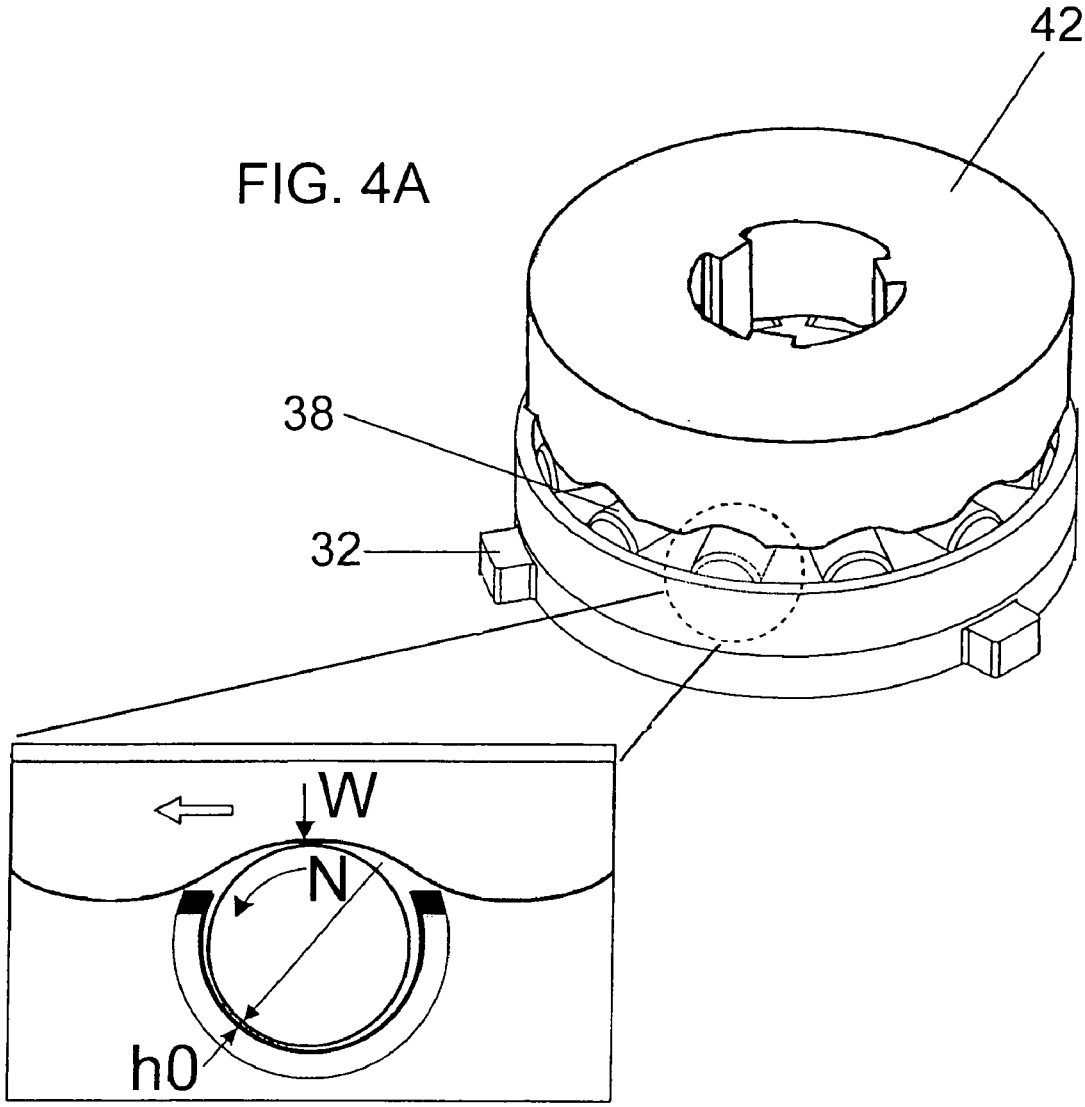
FIG. 4*a* is a three quarter, detail view of a portion of the wave race engaging with the roller hub assembly.
FIG. 4*b* is a detailed view of a roller bearing engaged with the wave race, showing the interaction of the lubrication film with the roller bearing and wave race.

Referring to FIG. 4*a,* the rolling hammer mechanism is shown in detail with parts of the hammer assembly 16 cut away for clarity. The twelve rollers 38 are mounted as independent journals in the stationary roller hub assembly 32, with the rotating wave race 42 creating a hammer drill action. A consistent lubrication film is maintained within each roller cavity through mating support geometry with continual and uninterrupted roller rotation.

Referring to FIG. 4*b,* wave race 42 produces the rotation shown. The result is a mechanism that has one side of each roller in true rolling contact with the wave race, while the other side of the roller is supported by the consistent hydrodynamic lubrication film of a journal bearing support. Force from the wave race is shown at W. The direction of roller 38 rotation is shown at N. When a journal bearing begins rotating, there is very little lubricant between the journal and pocket at the contact point, h0, and rubber occurs. Therefore, much friction needs to be overcome when starting a hydrodynamic journal bearing. When the bearing has reached sufficient speed, the lubricant begins to wedge into the contact area, shown as the heavy black line on the wave race and roller hub assembly. The rollers 38 of the stationary roller hub assembly 32 are not completely surrounded by the journal of the assembly 32. The broken lubrication film is totally restored by the wave race 42 which has partial arcs very similar to the missing portion of the journal. Hydrodynamic lift is attained and maintained in a continuous film of lubricant. Thus the rolling hammer drill mechanism is largely maintenance free.

The use of roller bearing engagement is to reduce friction, which generates heat and results in loss of energy. A formula for calculating energy generated by friction is as follows: $E=K\times F\times A$, where F=the acting force, A=the area of contact, K=the friction coefficient and E=energy. As can be seen from the given equation, all of the given components must be minimized to achieve the minimum energy. Acting force is a result of pressure applied by the operator through the tool on the drilling surface and cannot be minimized. Friction coefficient is a function of materials, surface grade and action character (dragging or rolling). In the case of ball bearing or roller bearing engagement, the friction coefficient is minimized because:

a) the rollers have a smoother surface than the teeth in tooth and tooth engagement; and
b) roller bearing engagement provides rolling action as opposed to dragging in tooth and tooth engagement.

The friction coefficient is significantly lower with roller bearing engagement than it is with tooth and tooth engagement.

Figures 5A, 5B:
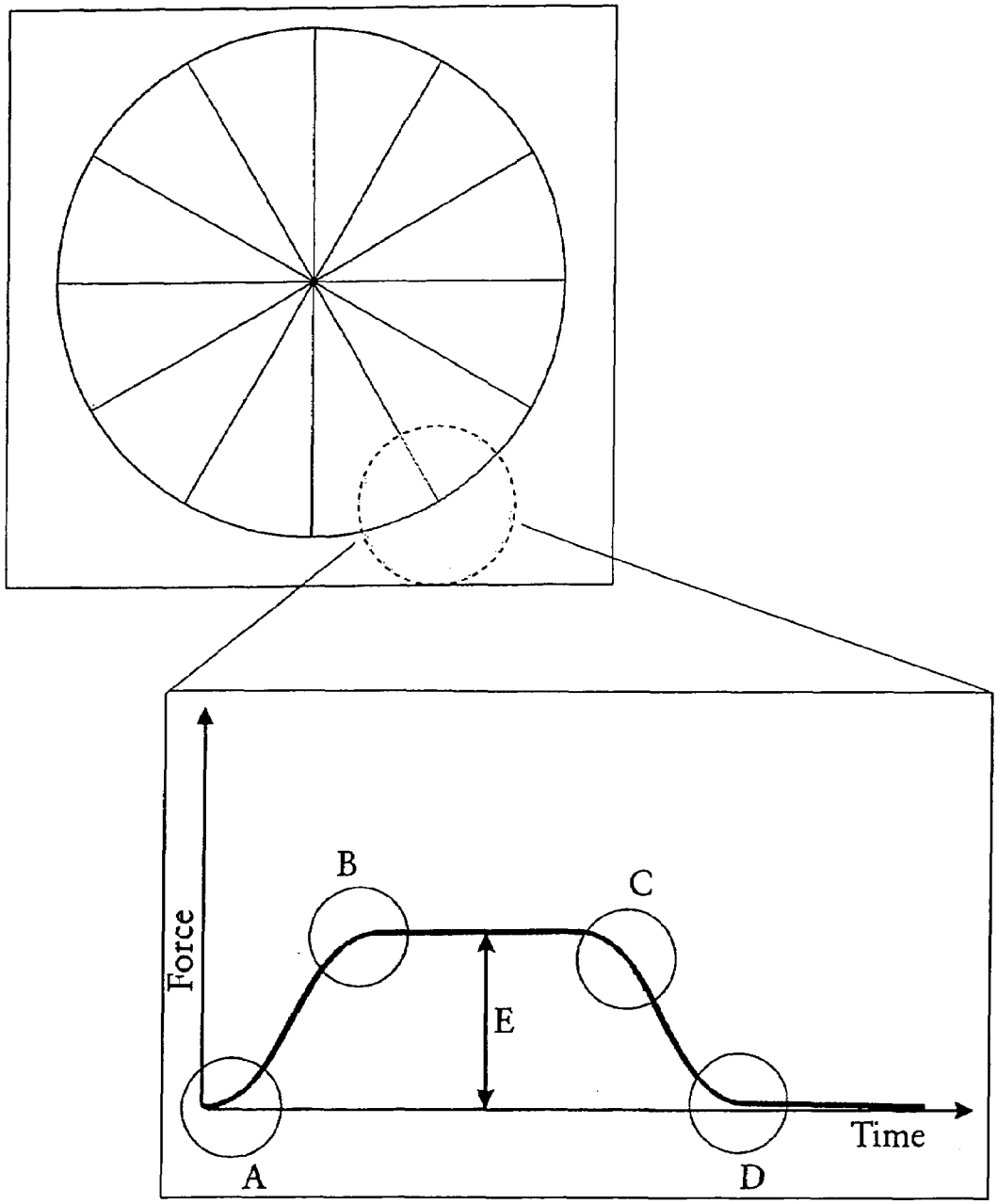
FIG. 5*a* is a diagram of one revolution of the rolling hammer drill mechanism.
FIG. 5*b* is an illustration of the impact frequency of the rolling hammer drill mechanism.

Referring to FIG. 5*a,* an illustration of one revolution of the rolling hammer mechanism, using twelve rollers, is shown. FIG. 5*b* is a detailed illustration of the shape of an impact pulse of the rolling hammer mechanism which occurs at each point where a roller engages a wave in the wave race. In FIG. 5*b:*

A is the smooth curve at the start of the impact;
B is the smooth transition to peak amplitude;
C is the amplitude maintained to that point, followed by smooth transition to the next cycle;
D is the smooth completion of the cycle; and
E shows that the amplitude and shape of the pulse will depend on the number of rollers used, and the shape of the wave race. A wide variety of designs for different applications is thus possible.

Smooth impact curves throughout the cycle results in faster drilling, improved hole shapes, reduced operator fatigue and long life of drill bits.

A person skilled in the art could make immaterial modifications to the invention described in this patent document without departing from the essence of the invention.

What is claimed is:

1. A roller hammer, comprising:

a housing;

a drive shaft supported by bearings within the housing for rotation relative to the housing and the drive shaft having an axis;

a set of rotating bearing elements supported within the housing and fixed in motion relative to the housing, the rotating bearing elements being distributed in a plane perpendicular to the axis of the drive shaft;

a hammer assembly incorporating a wave race, the hammer assembly being supported within the housing for axial and rotational movement relative to the housing, the drive shaft being connected to the hammer assembly to drive the hammer assembly while allowing axial movement between the drive shaft and hammer assembly; and the set of rotating bearing elements and the wave race facing each other within the housing and engaging each other continuously during a hammering operation to impart a hammer action on the hammer assembly as the drive shaft and hammer assembly rotate with each other in the housing under axial load.

2. The roller hammer of claim 1 in which the rotating bearing elements are roller bearings.

3. The roller hammer of claim 1 in which the wave race has a bearing surface that follows a sinusoidal contour.

4. The roller hammer of claim 1 in which the wave race has a smoothly undulating bearing surface.

5. The roller hammer of claim 4 in which the smoothly undulating bearing surface comprises equally spaced peaks and troughs.

6. The roller hammer of claim 1 in which axial forces are communicated from the drive shaft to the wave race only through contact between the rotating bearing elements and the wave race.

7. The roller hammer of claim 1 in which the drive shaft is the drive shaft of a power tool.

* * * * *